US009309699B2

(12) United States Patent
Tamura

(10) Patent No.: US 9,309,699 B2
(45) Date of Patent: Apr. 12, 2016

(54) LATCH DEVICE

(71) Applicant: MITSUI KINZOKU ACT CORPORATION, Yokohama-shi, Kanagawa (JP)

(72) Inventor: Shunsuke Tamura, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 281 days.

(21) Appl. No.: 13/975,731

(22) Filed: Aug. 26, 2013

(65) Prior Publication Data

US 2014/0062100 A1 Mar. 6, 2014

(30) Foreign Application Priority Data

Aug. 28, 2012 (JP) ..... 2012-187826
Aug. 30, 2012 (JP) ..... 2012-190543

(51) Int. Cl.

| | |
|---|---|
| ***E05C 19/10*** | (2006.01) |
| ***E05B 83/18*** | (2014.01) |
| ***E05B 81/06*** | (2014.01) |
| ***E05B 81/14*** | (2014.01) |
| ***E05B 81/34*** | (2014.01) |
| ***E05B 83/26*** | (2014.01) |
| ***E05B 85/26*** | (2014.01) |
| ***E05B 81/42*** | (2014.01) |
| *E05B 77/38* | (2014.01) |
| *E05B 77/40* | (2014.01) |
| *E05B 79/20* | (2014.01) |

(52) U.S. Cl.

CPC ..... *E05B 83/18* (2013.01); *E05B 81/06* (2013.01); *E05B 81/14* (2013.01); *E05B 81/34* (2013.01); *E05B 81/42* (2013.01); *E05B 83/26* (2013.01); *E05B 85/26* (2013.01); *E05B 77/38* (2013.01); *E05B 77/40* (2013.01); *E05B 79/20* (2013.01); *Y10T 292/0949* (2015.04)

(58) Field of Classification Search

USPC ..... 292/100, 215, 201, DIG. 23, 221
See application file for complete search history.

(56) References Cited

U.S. PATENT DOCUMENTS

| | | | | |
|---|---|---|---|---|
| 5,634,677 | A * | 6/1997 | Buscher et al. | 292/216 |
| 5,639,130 | A * | 6/1997 | Rogers et al. | 292/216 |
| 6,059,327 | A * | 5/2000 | Yoshikuwa | 292/216 |
| 2007/0216170 | A1 * | 9/2007 | Drescher et al. | 292/201 |

FOREIGN PATENT DOCUMENTS

| | | | |
|---|---|---|---|
| JP | 2010-101080 | A | 5/2010 |

* cited by examiner

*Primary Examiner* — Mark Williams
(74) *Attorney, Agent, or Firm* — McDermott Will & Emery LLP

(57) ABSTRACT

A latch device includes: a base plate; an open lever rotatably attached to the base plate; a biasing unit that biases the open lever; and an electric release unit to be installed in an electric release type latch device in which the open lever is operated by power and a manual release unit to be installed in a manual release type latch device in which the open lever is manually operated are capable of being selectively installed in the base plate. The open lever includes an action end portion to press a ratchet engaged with a latch and disengaging the ratchet from the latch. The biasing unit biases the open lever. The manual release unit is provided with a manual release stopping unit to abut against a driven portion.

9 Claims, 16 Drawing Sheets

LATCH DEVICE

CROSS-REFERENCE TO RELATED APPLICATIONS

The present application claims priority to and incorporates by reference the entire contents of Japanese Patent Application No. 2012-187826 filed in Japan on Aug. 28, 2012 and Japanese Patent Application No. 2012-190543 filed in Japan on Aug. 30, 2012.

BACKGROUND OF THE INVENTION

1. Field of the Invention

The present invention relates to a latch device favorably used for opening and closing a trunk lid which is to close a trunk room.

2. Description of the Related Art

A latch device to be installed in a vehicle such as an automobile includes a manual release type latch device and an electric release type latch device. Which of the manual release type latch device and the electric release type latch device should be installed in the vehicle is selected according to a type, a grade, and a specification of the vehicle. Thereby, for a purpose of reducing the number of part items to be managed or reducing the number of a stock of parts, standardization of parts is facilitated between the manual release type latch device and the electric release type latch device.

Specifically, in the manual release type latch device and the electric release type latch device, standardization of a base plate, a latch, and a ratchet is realized. An invention in which by adding a part to an open lever for the manual release type latch device (hereinafter, referred to as the "manual release open lever"), the open lever serves as an open lever for the electric release type latch device (hereinafter, referred to as the "electric release open lever") is proposed (for example, refer to Japanese Laid-open Patent Publication No. 2010-101080).

However, in the invention described above, by adding the part (spacer portion) to the manual release open lever, the open lever serves as the electric release open lever. Therefore, there is a need for stocking and managing both the manual release open lever and the electric release open lever or stocking and managing the manual release open lever and the part to be added. From this, standardization of the manual release open lever and the electric release open lever has been required.

In a case where the base plate is standardized, a stopper portion for stopping the open lever at a standby position is provided by cutting and bending the base plate. The stopper portion is provided while avoiding an arrangement space of a worm wheel installed in the electric release type latch device. Therefore, the latch device is not easily downsized.

SUMMARY OF THE INVENTION

It is an object of the present invention to at least partially solve the problems in the conventional technology.

According to an aspect of the present invention a latch device, includes: a base plate; an open lever rotatably attached to the base plate; a biasing unit that biases the open lever; and an electric release unit to be installed in an electric release type latch device in which the open lever is operated by power and a manual release unit to be installed in a manual release type latch device in which the open lever is manually operated are capable of being selectively installed in the base plate. The open lever includes an action end portion configured to press a ratchet engaged with a latch and disengaging the ratchet from the latch, the biasing unit biases the open lever in a direction in which the action end portion is taken away from the ratchet, and the manual release unit is provided with a manual release stopping unit to abut against a driven portion provided in the open lever in a case where the unit is installed in the base plate, so as to stop the open lever at a standby position.

According to another aspect of the present invention, the driven portion is provided between the action end portion and an operation portion and pressed by the electric release unit in a case where the electric release unit is installed, so as to operate the open lever by the power.

According to still another aspect of the present invention, the manual release stopping unit is provided in a case that constitutes the manual release unit.

According to still another aspect of the present invention, the case includes a connector configured to output a conduction signal.

According to still another aspect of the present invention, the electric release unit includes a worm wheel configured to press the driven portion so as to operate the open lever by the power, and the worm wheel serves as an electric release stopping unit that stops the open lever at the standby position in a case where the worm wheel stops at a stop position.

According to still another aspect of the present invention, a latch device to be attached to any one of a trunk main body or a trunk lid forming a trunk room in a vehicle is an application object, an operation handle facing an interior of the trunk room in a state that the trunk lid is closed is provided in the open lever, and a support member to abut against the operation handle at least in a state that the open lever is placed at the standby position and in a case where a pressing load is applied to the operation handle from the side of the trunk room, so as to support the operation handle is provided.

According to still another aspect of the present invention, the operation handle is provided so as to move along a surface facing the trunk room in a case where the open lever is operated by the power or manually, and the support member is provided so as to overlap with the operation handle in a direction orthogonal to the moving direction of the operation handle.

According to still another aspect of the present invention, the operation handle includes a fitting portion to be fitted to the operation portion of the open lever, and a display portion extending in a operation direction of the open lever from the fitting portion, and the display portion and the support member overlap with each other.

According to still another aspect of the present invention, the support member is a case that constitutes the electric release unit or a case that constitutes the manual release unit.

According to still another aspect of the present invention, the case includes a rib on a surface facing the operation handle.

According to still another aspect of the present invention, the latch device further includes: a protector cover configured to cover the open lever in a state that the operation handle is exposed to an exterior. The protector cover includes: a reference surface configured to regulate a reference position serving as a border from the trunk room; a protector surface extending along a periphery of the operation handle and protruding toward the inside of the trunk room with respect to the reference surface; and an inclined surface connecting the reference surface and the protector surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
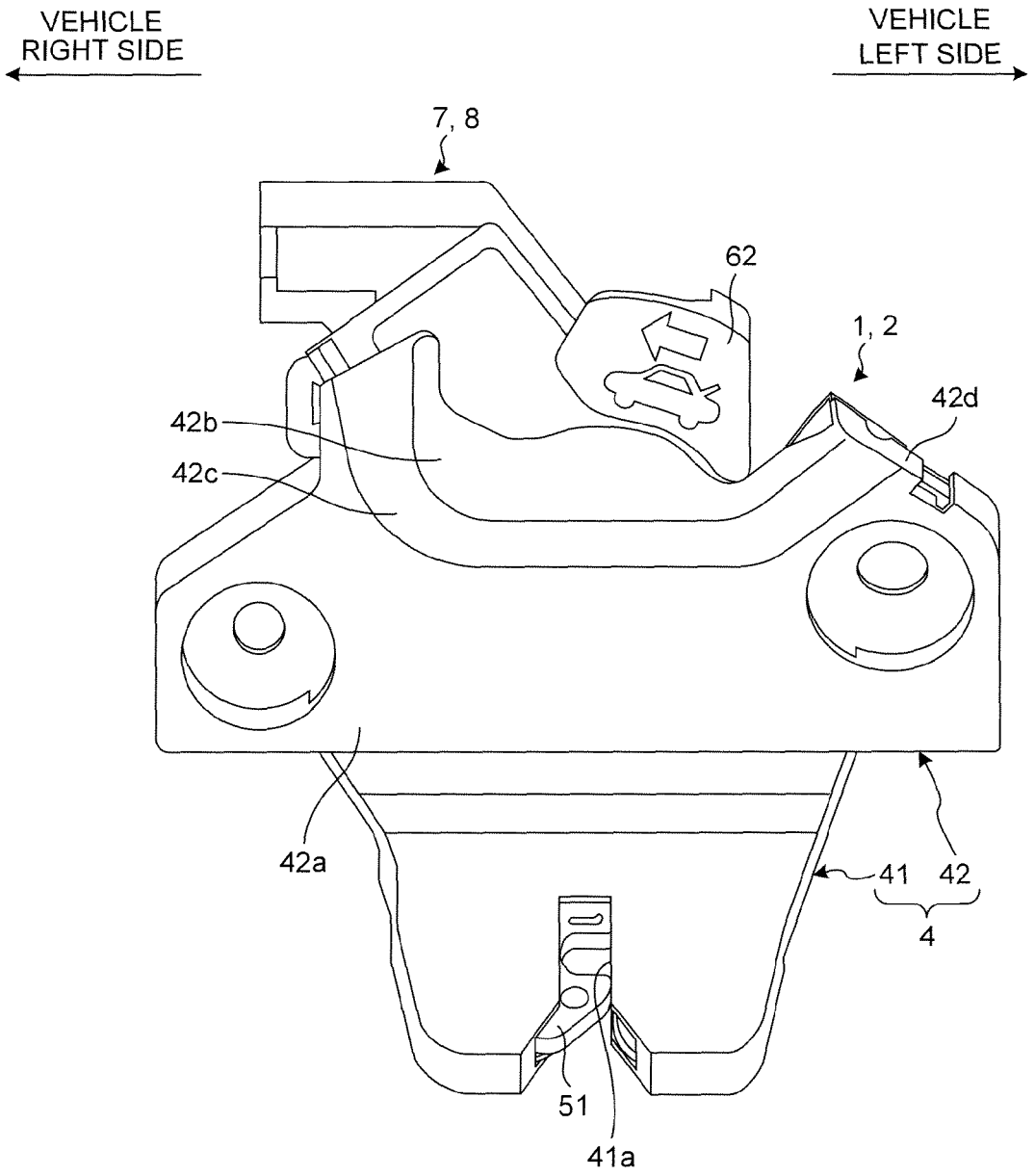
FIG. 1 is a front view illustrating an outer appearance of an electric release type latch device and a manual release type latch device.

Hereinafter, with reference to the drawings, an embodiment of a latch device according to the present invention will be described in detail. It should be noted that in all the drawings for explaining the embodiment, parts having the same functions will be given the same reference signs, and repeated description thereof will be omitted. The vehicle right side and the vehicle left side in the drawings respectively indicate the right side and the left side in a case where the vehicle front side is seen from a vehicle rear end.

Figure 2:
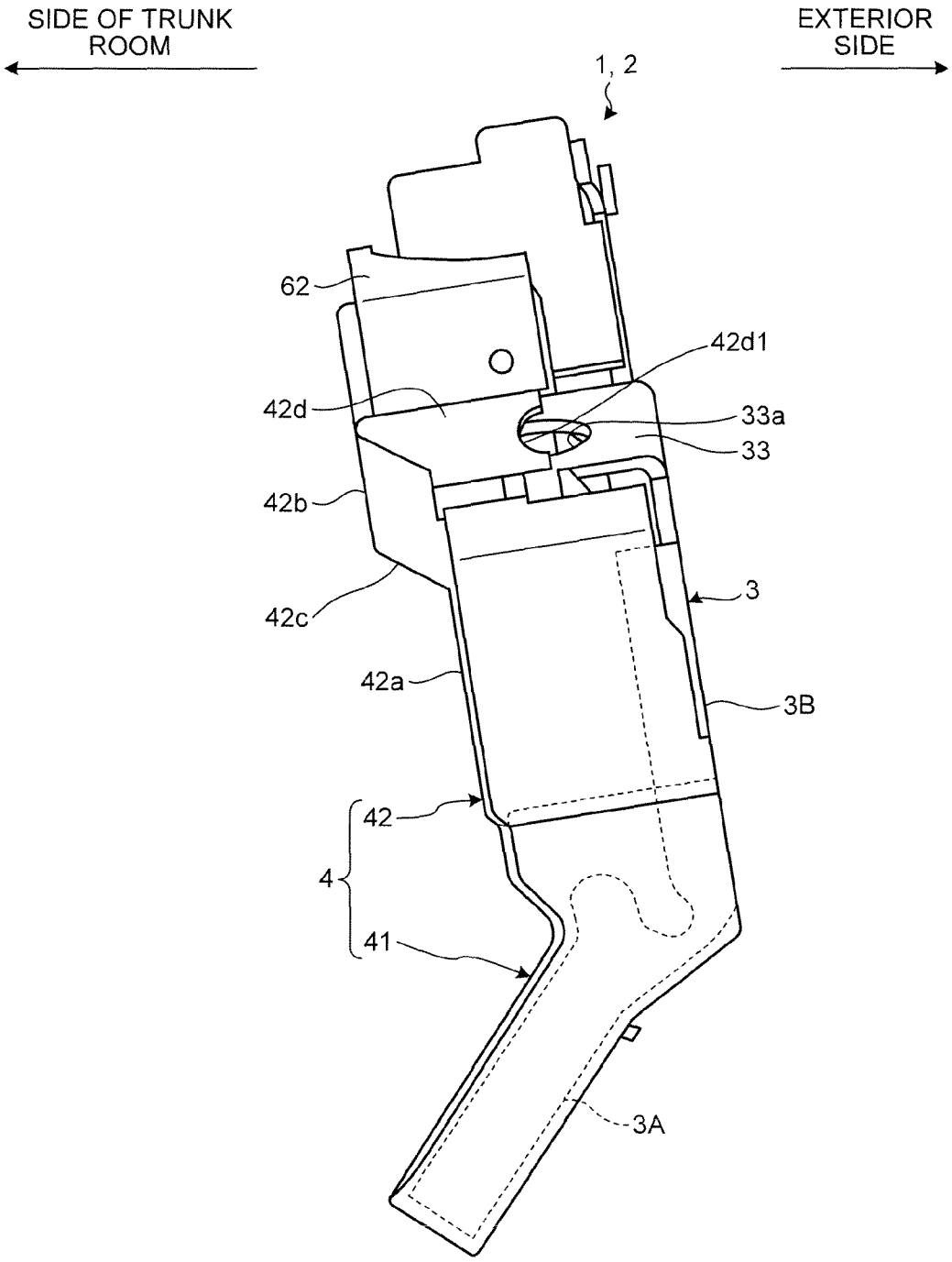
FIG. 2 is a side view of the latch device illustrated in FIG. 1.

FIG. 1 is a front view illustrating an outer appearance of the latch device serving as the embodiment of the present invention. FIG. 2 is a side view of the latch device illustrated in FIG. 1.

In the present embodiment, an example is given in which the latch device for retaining a trunk lid provided in a rear end part of a vehicle main body in a closed state. It is assumed that the latch device is attached to the trunk lid.

As illustrated in FIGS. 1 and 2, the latch device of the present embodiment has the substantially same outer appearance both in a case of an electric release type latch device 1 and in a case of a manual release type latch device 2. Each of the electric release type latch device 1 and the manual release type latch device 2 is provided with a base plate 3 and a protector cover 4 of the same shape. An accommodation space for a latch 51, a ratchet 52, an open lever 6 (refer to FIG. 3), and the like is provided between the base plate 3 and the protector cover 4. In the electric release type latch device 1, an actuator 7 serving as an electric release unit for operating the open lever 6 by power is installed in the base plate 3. Meanwhile, in the manual release type latch device 2, in place of the actuator 7, a case 8 serving as a manual release unit is installed in the base plate 3.

Figure 3:
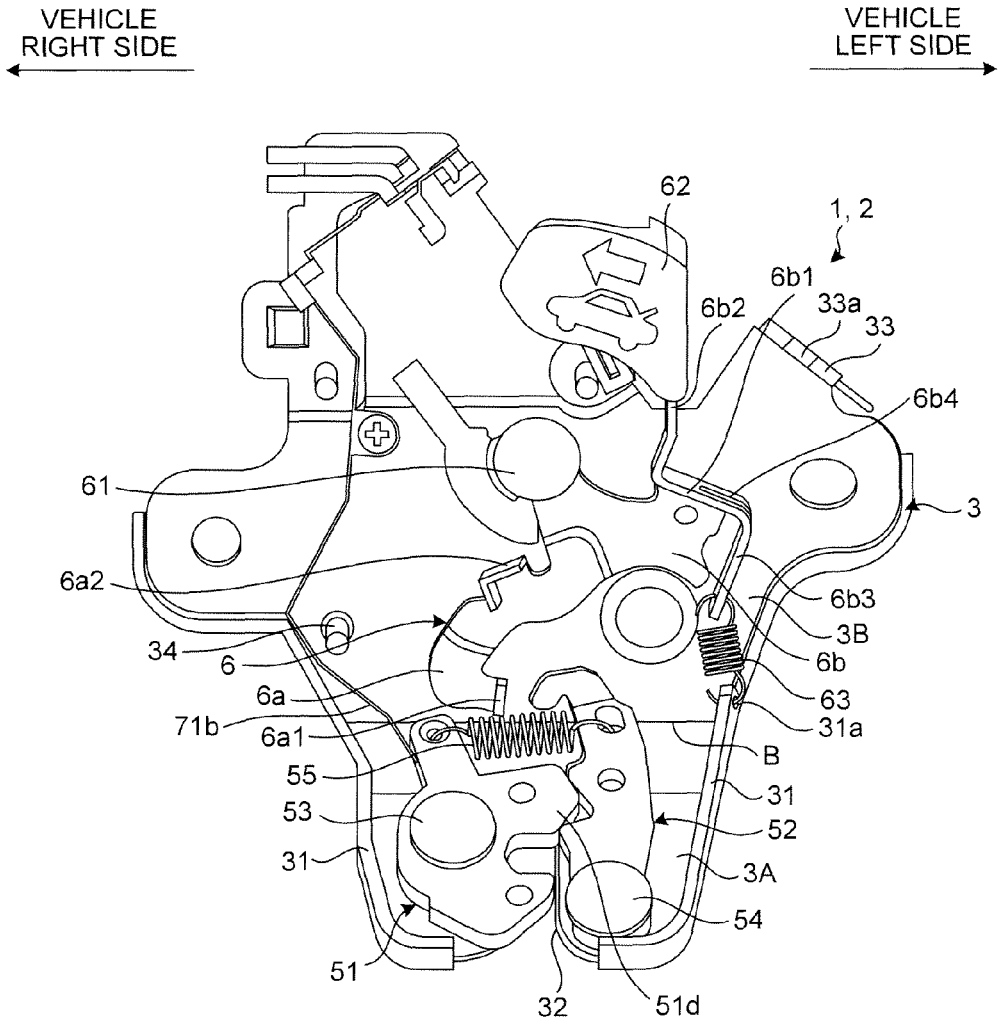
FIG. 3 is a front view illustrating an internal configuration which is common to the electric release type latch device and the manual release type latch device, and is a view illustrating a state that an open lever is moved to a standby position.
Figure 4:
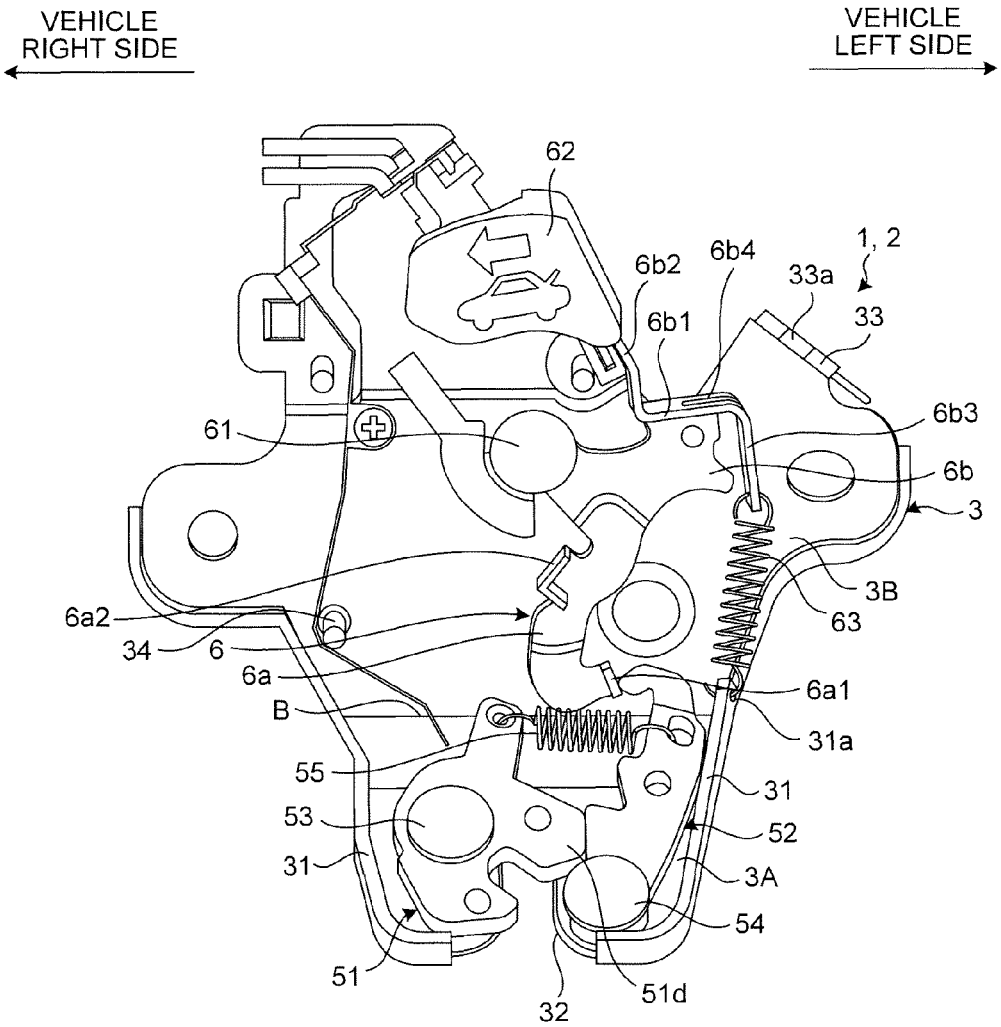
FIG. 4 is a front view illustrating the internal configuration which is common to the electric release type latch device and the manual release type latch device, and is a view illustrating a state that the open lever is moved to an operation position.
Figure 5:
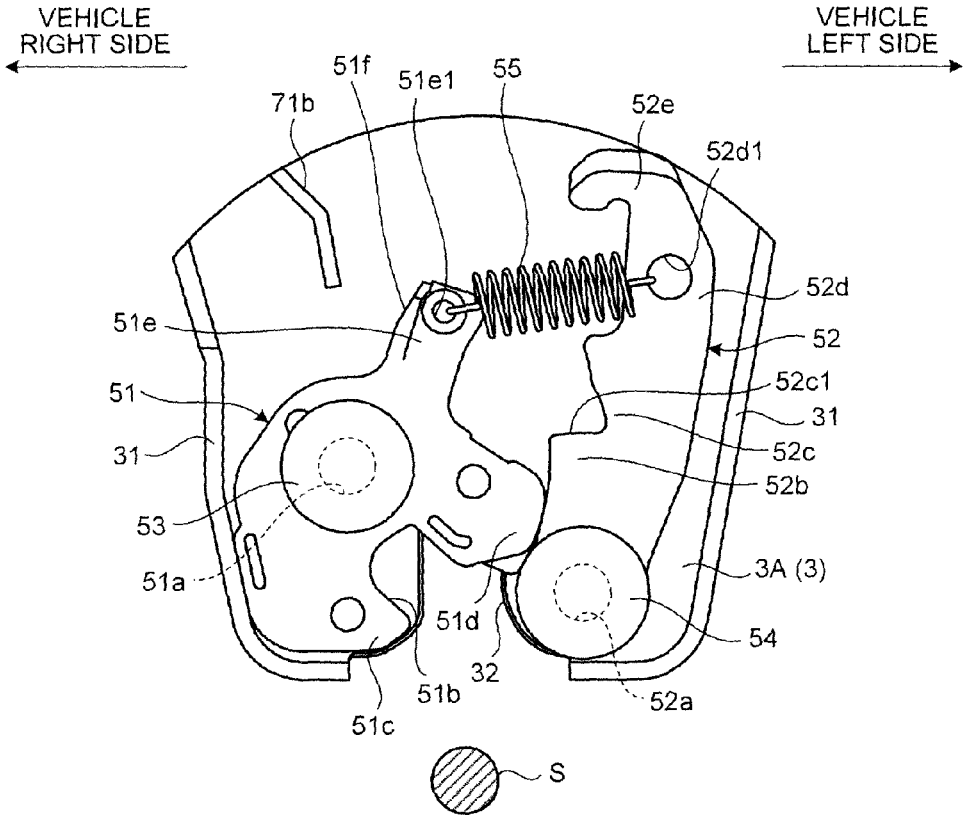
FIG. 5 is a front view in which a latch and a ratchet illustrated in FIG. 4 are enlarged.
Figure 6:
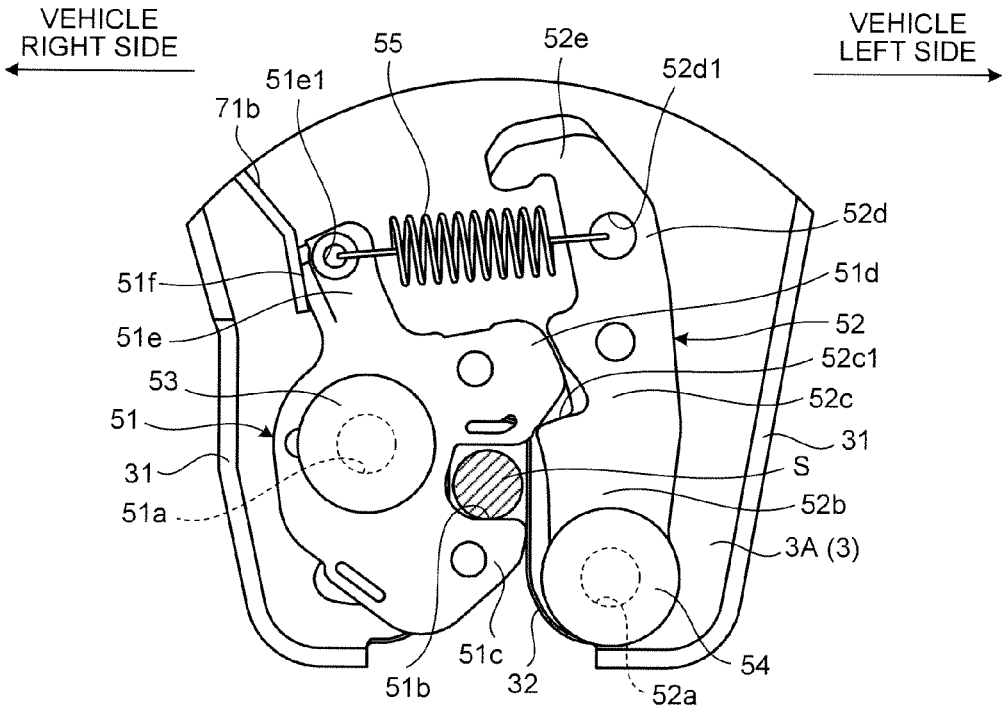
FIG. 6 is a front view in which the latch and the ratchet illustrated in FIG. 3 are enlarged.
Figure 7:
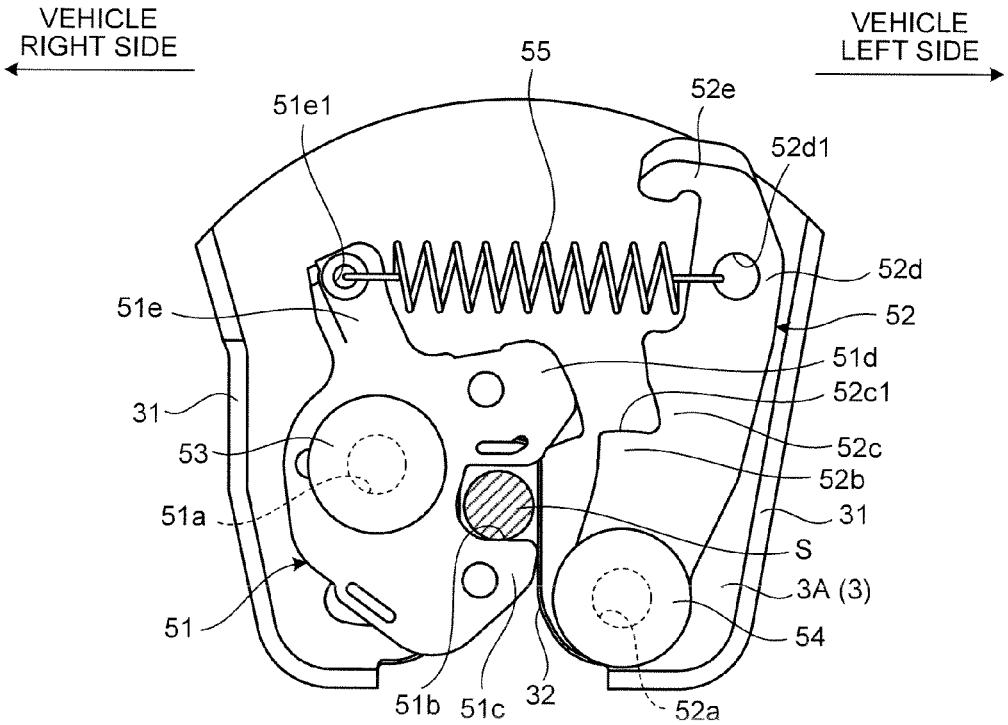
FIG. 7 is a front view illustrating a state that the ratchet is disengaged from the latch.
Figure 8:
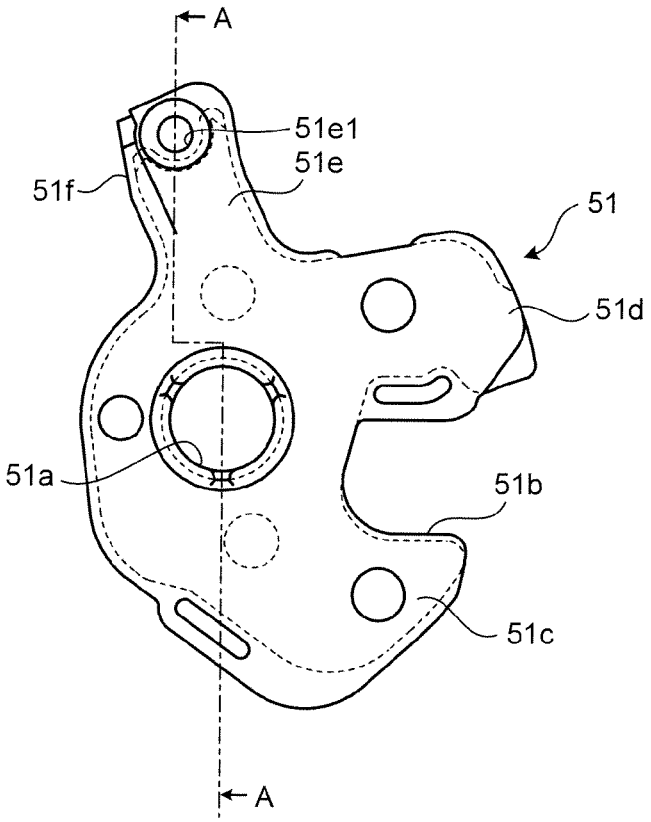
FIG. 8 is a front view illustrating a detail of the latch.
Figure 9:
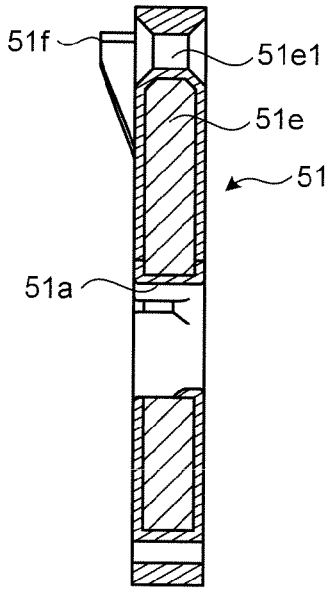
FIG. 9 is a sectional view by line A-A of the latch illustrated in FIG. 8.

FIG. 3 is a front view illustrating an internal configuration which is common to the electric release type latch device and the manual release type latch device, and is a view illustrating a state that the open lever is moved to a standby position. FIG. 4 is a front view illustrating the internal configuration which is common to the electric release type latch device and the manual release type latch device, and is a view illustrating a state that the open lever is moved to an operation position. FIG. 5 is a front view in which the latch and the ratchet illustrated in FIG. 4 are enlarged. FIG. 6 is a front view in which the latch and the ratchet illustrated in FIG. 3 are enlarged. FIG. 7 is a front view illustrating a state that the ratchet is disengaged from the latch. FIG. 8 is a front view illustrating a detail of the latch. FIG. 9 is a sectional view by line A-A of the latch illustrated in FIG. 8.

The base plate 3 is formed by press-molding a metal plate, and as illustrated in FIGS. 3 and 4, divided into a lower region 3A and an upper region 3B with respect to a border B extending in the horizontal direction. The latch 51 and the ratchet 52 are arranged in the lower region 3A, and the open lever 6 and others are arranged in the upper region 3B. The base plate 3 is bent at the border B as illustrated in FIG. 2. Ribs 31 are bent and formed on both side edges of the lower region 3A and the upper region 3B.

A striker incoming groove 32 into which a striker S (refer to FIG. 6), provided in the vehicle main body, enters is provided in the lower region 3A of the base plate 3. The striker incoming groove 32 is a cutout provided at a position serving as substantial center of the width direction (vehicle left and right direction) in the lower region 3A from a lower edge of the lower region 3A toward the upper region 3B. The striker incoming groove 32 is formed to have a width that can accommodate the striker S as illustrated in FIG. 6.

A latch shaft 53 and a ratchet shaft 54 are secured to the lower region 3A of the base plate 3. The latch shaft 53 is secured on the vehicle right side with respect to the striker incoming groove 32. The ratchet shaft 54 is secured on the vehicle left side with respect to the striker incoming groove 32.

The latch 51 is rotatably attached to the latch shaft 53. As illustrated in FIG. 5, an outer peripheral surface of the latch 51 abuts against the rib 31 of the base plate 3, so that clockwise rotation of the latch is regulated. Hereinafter, a position of the latch 51 where the latch abuts against the rib 31 of the base plate 3 and the clockwise rotation is regulated is defined as an open position. The latch 51 is insert-molded, and as illustrated in FIGS. 5 and 8, includes a shaft hole 51*a*, a meshing groove 51*b*, a hook portion 51*c*, a locking portion 51*d*, a spring installment portion 51*e*, and a signal terminal pressing portion 51*f*.

The shaft hole 51*a* is a hole into which the latch shaft 53 is inserted. The meshing groove 51*b* is a groove formed from the outer peripheral surface of the latch 51 toward the shaft hole 51*a*. The meshing groove 51*b* is formed to have a width that can accommodate the striker S as illustrated in FIG. 6. The meshing groove 51*b* is also formed at a position where the striker S coming into the striker incoming groove 32 can be guided into the meshing groove 51*b* in a case where the latch 51 is placed at the open position as illustrated in FIG. 5. The hook portion 51*c* is a part placed on the vehicle right side of the striker incoming groove 32 in a case where the latch 51 is placed at the open position as illustrated in FIG. 5. The hook portion 51*c* is formed so as to traverse the striker incoming groove 32 as illustrated in FIG. 6 in a case where the latch 51 is rotated counter-clockwise from the open position.

The locking portion 51*d* is a part placed on the vehicle left side of the meshing groove 51*b* in a case where the latch 51 is placed at the open position as illustrated in FIG. 5. The locking portion 51*d* is formed so as to abut against and engage with an engagement portion 52*c* of the ratchet 52 as illustrated in FIG. 6 in a case where the latch 51 is rotated counter-clockwise from the open position and the hook portion 51*c* reaches the position to traverse the striker incoming groove 32 At this time, the engagement portion 52*c* of the ratchet 52 abuts against and engages with the locking portion 51*d* of the latch 51 in a state that the engagement portion stops rotation of the latch 51 toward the open position. Hereinafter, a position of the latch 51 where the locking portion 51*d* of the latch 51 and the engagement portion 52*c* of the ratchet 52 abut against and engage with each other is defined as a latch position.

The spring installment portion 51*e* is a part placed on the substantially opposite side of the hook portion 51*c* with respect to the shaft hole 51*a*, and formed from the shaft hole 51*a* in the radially outward direction. A spring installment hole 51*e*1 onto which one end of a pulling coil spring 55 is hooked is formed in an end part of the spring installment portion 51*e*. The spring installment hole 51*e*1 passes through a resin part in the spring installment portion 51*e*. As illustrated in FIG. 9, an opening end part of the spring installment hole 51*e*1 is formed into a tapered shape in which a hole diameter is gradually reduced from an opening end toward center in the depth direction. Therefore, the one end of the pulling coil spring 55 can be easily hooked onto the spring installment hole 51*e*1. Since the spring installment hole 51*e*1 is formed by resin molding and the opening end part is formed into a tapered shape, the one end of the pulling coil spring 55 hooked onto the spring installment hole 51*e*1 is not easily cut off.

The signal terminal pressing portion 51*f* is a part placed on the left side of the spring installment portion 51*e* (vehicle right side). The signal terminal pressing portion 51*f* is away from a signal terminal 71*b* in a case where the latch 51 is placed at the open position as illustrated in FIG. 5. When the latch 51 is rotated from the open position to the latch position, the signal terminal pressing portion 51*f* presses the signal terminal 71*b* as illustrated in FIG. 6.

The ratchet 52 is rotatably attached to the ratchet shaft 54. The ratchet 52 is formed by press-molding a metal plate, and as illustrated in FIG. 5, includes a shaft hole 52*a*, an abutment portion 52*b*, the engagement portion 52*c*, a spring installment portion 52*d*, and an action end portion 52*e*.

The shaft hole 52*a* is a hole through which the ratchet shaft 54 is inserted. The abutment portion 52*b* is a part extending in the radially outward direction from the shaft hole 52*a*. The abutment portion 52*b* is formed so as to abut against the locking portion 51*d* of the latch 51 placed at the open position as illustrated in FIG. 5 and so as to slide contact with the locking portion 51*d* when the latch 51 is rotated from the open position to the latch position. The engagement portion 52*c* is a recessed part formed on an outer peripheral surface extending in the radially outward direction from the shaft hole 52*a* and exceeding the abutment portion 52*b*. The engagement portion 52*c* is formed so as to abut against and engage with the locking portion 51*d* of the latch 51 via an end surface 52*c*1 serving as a border from the abutment portion 52*b* as illustrated in FIG. 6 in a case where the latch 51 is rotated to the latch position. The end surface 52*c*1 of the abutment portion 52*b* is formed in the direction in which the rotation of the latch 51 to the open position is blocked.

The spring installment portion 52*d* is a part extending from the shaft hole 52*a* and exceeding the engagement portion 52*c*. A spring installment hole 52*d*1 onto which the other end of the pulling coil spring 55 is hooked is formed at a position substantially center in the width direction in the spring installment portion 52*d*. The action end portion 52*e* is a part extending from the shaft hole 52*a* and exceeding the spring installment portion 52*d*. The action end portion 52*e* is bent onto the side of the upper region 3B so as to be substantially parallel to the upper region 3B of the base plate 3.

The pulling coil spring 55 is installed between the spring installment portion 51*e* of the latch 51 and the spring installment portion 52*d* of the ratchet 52 as illustrated in FIGS. 5 to 7. The pulling coil spring 55 is a spring for biasing the latch 51 and the ratchet 52. The pulling coil spring 55 always biases the latch 51 in the direction in which the latch 51 is rotated to the open position (clockwise direction in FIGS. 5 to 7). The pulling coil spring 55 always biases the ratchet 52 in the direction in which the ratchet 52 is closely attached to the latch 51 (counter-clockwise direction in FIGS. 5 to 7). Thereby, in a case where the latch 51 is placed at the open position, the latch 51 is abutted with an inner wall surface of the rib 31 provided in the lower region 3A and stopped as illustrated in FIG. 5. In a case where the latch 51 is placed at the open position, the abutment portion 52*b* of the ratchet 52 is abutted with an outer periphery of the locking portion 51*d* of the latch 51. Meanwhile, in a case where the latch 51 is placed at the latch position, the locking portion 51*d* of the latch 51 and the engagement portion 52*c* of the ratchet 52 are abutted and engaged with each other and the latch 51 is stopped at the latch position as illustrated in FIG. 6. Further, in a case where the latch 51 is placed at the latch position and when the ratchet 52 is rotated in the clockwise direction and the ratchet 52 is disengaged from the latch 51 as illustrated in FIG. 7, the latch 51 is rotated in the direction of the open position (clockwise direction in FIG. 7).

Regarding the latch 51 and the ratchet 52 formed as described above, in a case where the trunk lid is opened with respect to the vehicle main body, the latch 51 is stopped at the open position and the abutment portion 52*b* of the ratchet 52 abuts against the locking portion 51*d* of the latch 51 as illustrated in FIG. 5. When a close operation of the trunk lid is performed from this state, the striker S provided in the vehicle main body comes into the striker incoming groove 32 and eventually the striker S abuts against the meshing groove 51*b* of the latch 51 so as to press the latch 51. As a result, the latch 51 is rotated in the direction of the latch position (counter-clockwise direction in FIG. 5) against biasing force of the pulling coil spring 55. In the meantime, regarding the ratchet 52, an outer peripheral surface of the abutment portion 52*b* is brought into sliding contact with an outer peripheral surface of the locking portion 51*d* of the latch 51 by the biasing force of the pulling coil spring 55.

When the close operation of the trunk lid is further performed from the above state, an incoming amount of the striker S into the striker incoming groove 32 gradually increases. Therefore, the latch 51 is further rotated in the direction of the latch position and eventually reaches the latch position where the locking portion 51*d* of the latch 51 is engageable with the engagement portion 52*c* of the ratchet 52. When the latch 51 reaches the latch position, the state is brought into a latched state that the locking portion 51*d* of the latch 51 abuts against and engages with the engagement portion 52*c* of the ratchet 52 as illustrated in FIG. 6. In the latched state, the rotation of the latch 51 in the direction of the open position (clockwise direction in FIG. 6) by the biasing force of the pulling coil spring 55 is blocked. Moreover, in the latched state, the hook portion 51*c* of the latch 51 traverses the striker incoming groove 32 at a position between the striker S and an incoming port of the striker incoming groove 32. Therefore, in the latched state, movement of the striker S in the direction in which the striker is disengaged from the striker incoming groove 32 is blocked by the hook portion 51*c*. That is, in the latched state, an open action of the trunk lid with respect to the vehicle main body is blocked, so that the trunk lid is retained in a closed state. Thereby, a trunk room is closed.

When the trunk lid retained in a closed state is opened, the ratchet 52 is rotated in the direction in which the ratchet is disengaged from the latch 51 (clockwise direction in FIG. 7) as illustrated in FIG. 7. When abutment and engagement between the locking portion 51*d* of the latch 51 and the engagement portion 52*c* of the ratchet 52 are released, the state is brought into a state that the latch 51 is rotatable in the direction of the open position (clockwise direction in FIG. 7). When the trunk lid is moved in the open direction in this state, the striker S moves in the direction in which the striker is disengaged from the striker incoming groove 32 and the latch 51 rotates in the direction of the open position. When the trunk lid further moves in the open direction after that, the latch 51 and the ratchet 52 are brought into an unlatched state illustrated in FIG. 5 and the striker S disengages from the striker incoming groove 32. Thereby, the trunk lid can be opened, so that articles can be accommodated in the trunk room or articles of the trunk room can be taken out.

The abutment and the engagement between the locking portion 51*d* of the latch 51 and the engagement portion 52*c* of the ratchet 52 are released by operating the open lever 6 arranged in the upper region 3B of the base plate 3.

An open lever shaft 61 is secured at a position substantially center of the upper region 3B of the base plate 3 as illustrated in FIGS. 3 and 4. The open lever 6 is rotatably attached to the open lever shaft 61. The open lever shaft 61 is installed upright in the upper region 3B of the base plate 3. Therefore, the open lever 6 rotates in a plane which is substantially parallel to the upper region 3B of the base plate 3. The open lever 6 is formed by press-molding a metal plate, and includes a shaft hole (not illustrated), an action portion 6*a*, and an operation portion 6*b*.

The action portion 6*a* is a part for rotating the ratchet 52 engaged with the locking portion 51*d* of the latch 51 in the direction in which the ratchet is disengaged from the latch 51. The action portion 6*a* extends downward and slightly leftward from the open lever shaft 61. A lower end of the action portion 6*a* is placed on the vehicle right side of the action end portion 52*e* of the ratchet 52 as illustrated in FIGS. 3 and 4. An action end portion 6*a*1 is provided in the lower end of the action portion 6*a*. The action end portion 6*a*1 is provided by bending a part of a lower end part of the action portion 6*a* on the side of the ratchet 52 toward the vehicle front side. The action end portion 6*a*1 is arranged at a position facing the action end portion 52*e* of the ratchet 52 with a slight gap as illustrated in FIG. 3 in a case where the open lever 6 is not operated. When the open lever 6 is operated for releasing the abutment and the engagement between the latch 51 and the ratchet 52, the action end portion 6*a*1 is rotated to a position for pressing the action end portion 52*e* of the ratchet 52 as illustrated in FIG. 4. That is, the open lever 6 stands by at the standby position where the action end portion 6*a*1 and the action end portion 52*e* of the ratchet 52 are away from each other at the time of non-operation. Meanwhile, at the time of operation by the power or at the time of manual operation, the action end portion 6*a*1 rotates to the operation position for pressing the action end portion 52*e* of the ratchet 52.

A driven portion 6*a*2 is provided in the action portion 6*a* of the open lever 6. The driven portion 6*a*2 is provided between the action end portion 6*a*1 and the operation portion 6*b*. As described later, the driven portion 6*a*2 is a part to be pressed by the actuator 7 in the electric release type latch device 1 and to be abutted with a stopper portion 81 of the case 8 in the manual release type latch device 2. The driven portion 6*a*2 is formed into an L shape by bending an end part on the vehicle right side between the action end portion 6*a*1 and the operation portion 6*b*.

The operation portion 6*b* is a part to which operation force at the time of manual operation or the like is applied, and extends rightward and slightly downward from the open lever shaft 61. A base portion 6*b*1 is provided in an upper end part of the operation portion 6*b*. The base portion 6*b*1 is bent so as to face the vehicle front side. A wire installment groove 6*b*4 is formed in the base portion 6*b*1. The wire installment groove 6*b*4 is a groove into which a wire of an operation cable (not illustrated) to be interlocked to a trunk lever or the like provided under a driver seat is installed in a case of the manual release type latch device 2. The operation cable is attached to a cable attachment portion 33 provided in the base plate 3 and a cable attachment portion 42*d* of the protector cover 4 illustrated in FIG. 2. One end of the wire of the operation cable is installed into the wire installment groove 6*b*4 through a cable insertion hole formed by a recessed portion 33*a* which is provided in the cable attachment portion 33 of the base plate 3 and a recessed portion 42*d*1 which is provided in the cable attachment portion 42*d* of a second cover 42. In the manual release type latch device 2, in a case where an open operation of the trunk lever is performed, the open lever 6 rotates to the operation position illustrated in FIG. 4.

The operation portion 6*b* of the open lever 6 diverges into two directions from the base portion 6*b*1. An operation end portion 6*b*2 is provided in one of the parts diverged from the base portion 6*b*1. The operation end portion 6*b*2 is a part for allowing an operation of the open lever 6 from an interior of the trunk room. The operation end portion 6*b*2 extends upward from the base portion 6*b*1 and extends toward the outside from between the base plate 3 and the protector cover 4 (refer to FIG. 1). An operation handle 62 is attached to the operation end portion 6*b*2. The operation handle 62 is a member for enabling a person locked in the trunk room to operate the open lever 6. The operation handle 62 is formed by a phosphorescent resin material. A mark such as an arrow indicating the operation direction is provided on a surface of the operation handle 62 facing the side of the trunk room.

Thereby, the operation handle 62 and the operation direction can be identified even in the dark.

A spring installment portion 6*b*3 is provided in the other part diverged from the base portion 6*b*1. The spring installment portion 6*b*3 extends downward from the base portion 6*b*1. A hook (not illustrated) onto which one end of a pulling coil spring 63 is hooked is formed in an end part of the spring installment portion 6*b*3. The other end of the pulling coil spring 63 is hooked onto a spring installment portion 31*a* provided in the rib 31 of the base plate 3. The pulling coil spring 63 always biases the open lever 6 so that the open lever 6 returns to the standby position after the open operation. Thereby, when a grip on the operation handle 62 is released after the open operation of the operation handle 62 is performed, the open lever 6 always rotates toward the standby position.

Figure 10:
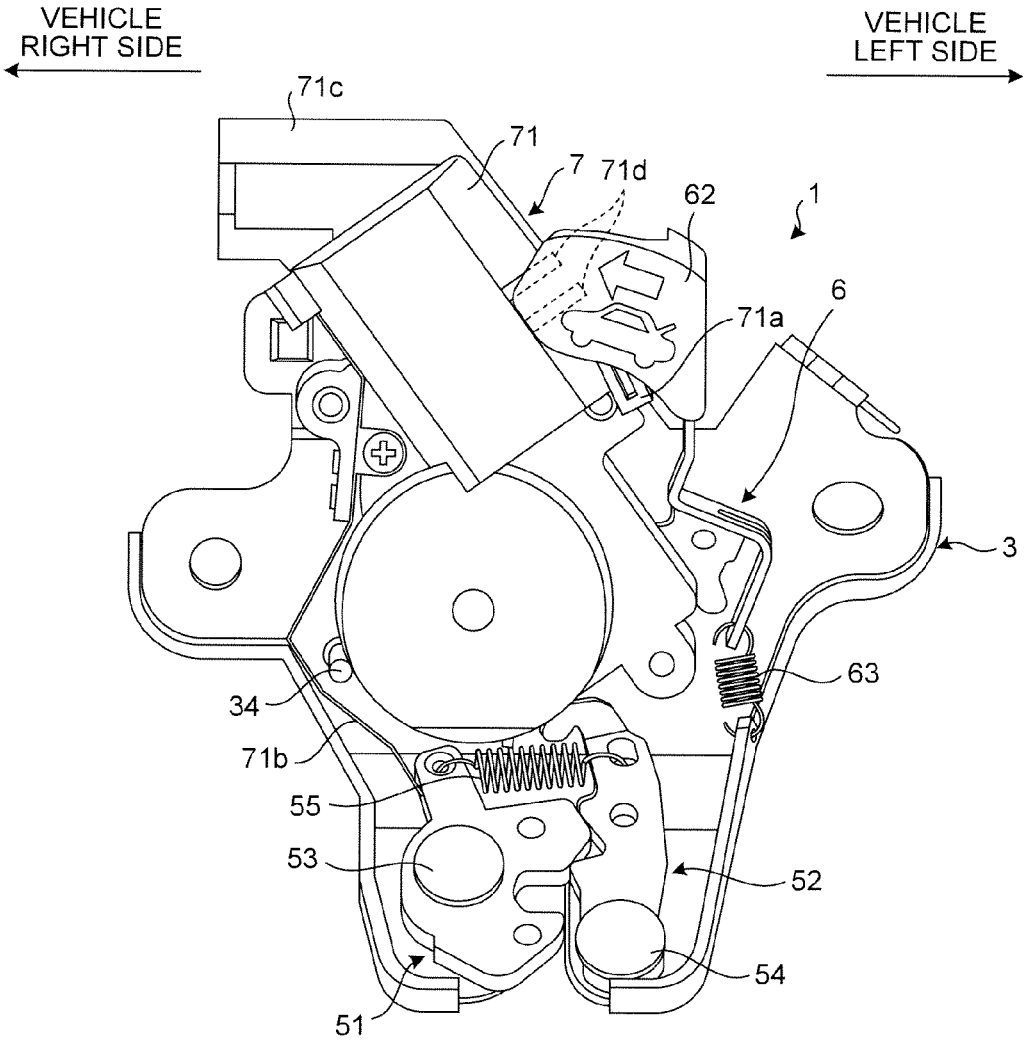
FIG. 10 is a front view illustrating the internal configuration when the electric release type latch device illustrated in FIG. 1 is in a latched state.
Figure 11:
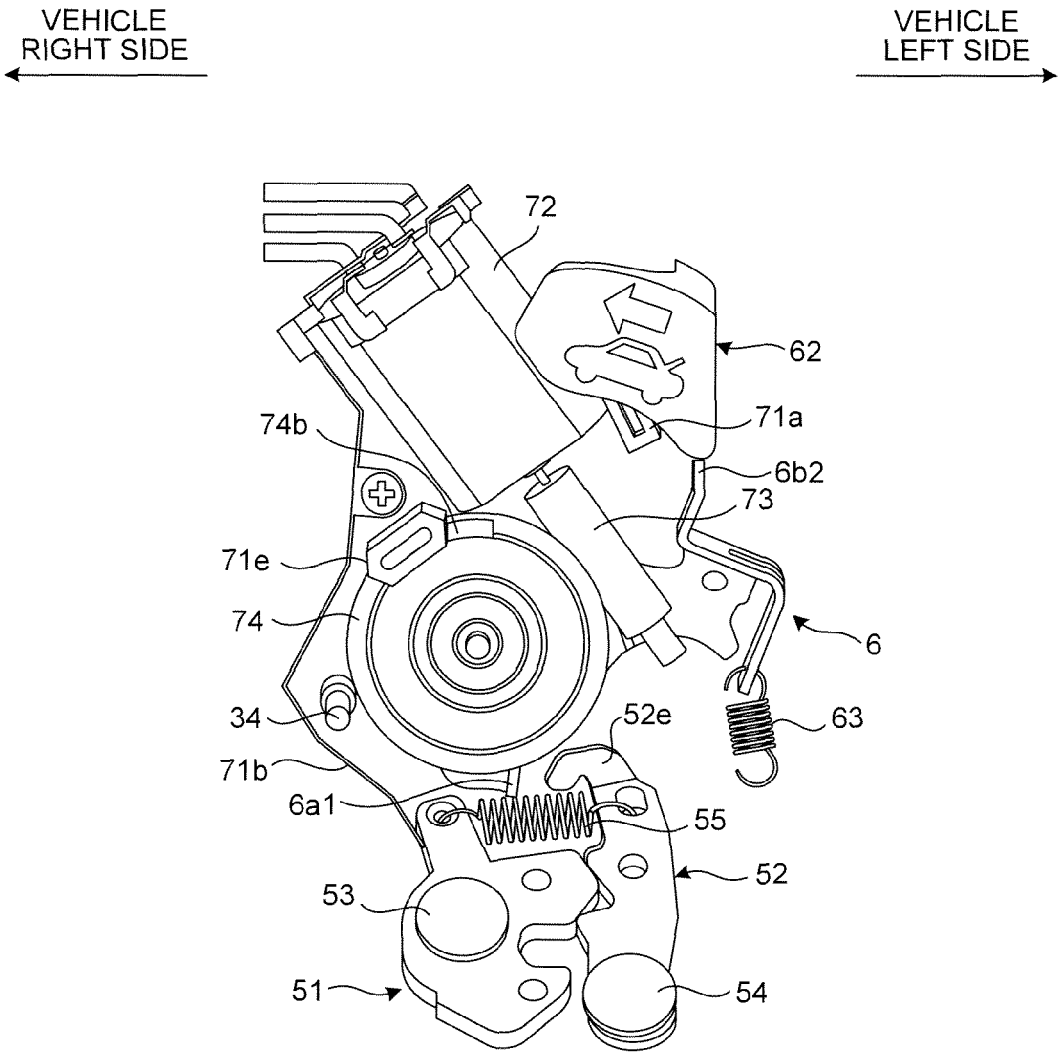
FIG. 11 is a view illustrating major parts of the internal configuration including a configuration of an actuator illustrated in FIG. 10.
Figure 12:
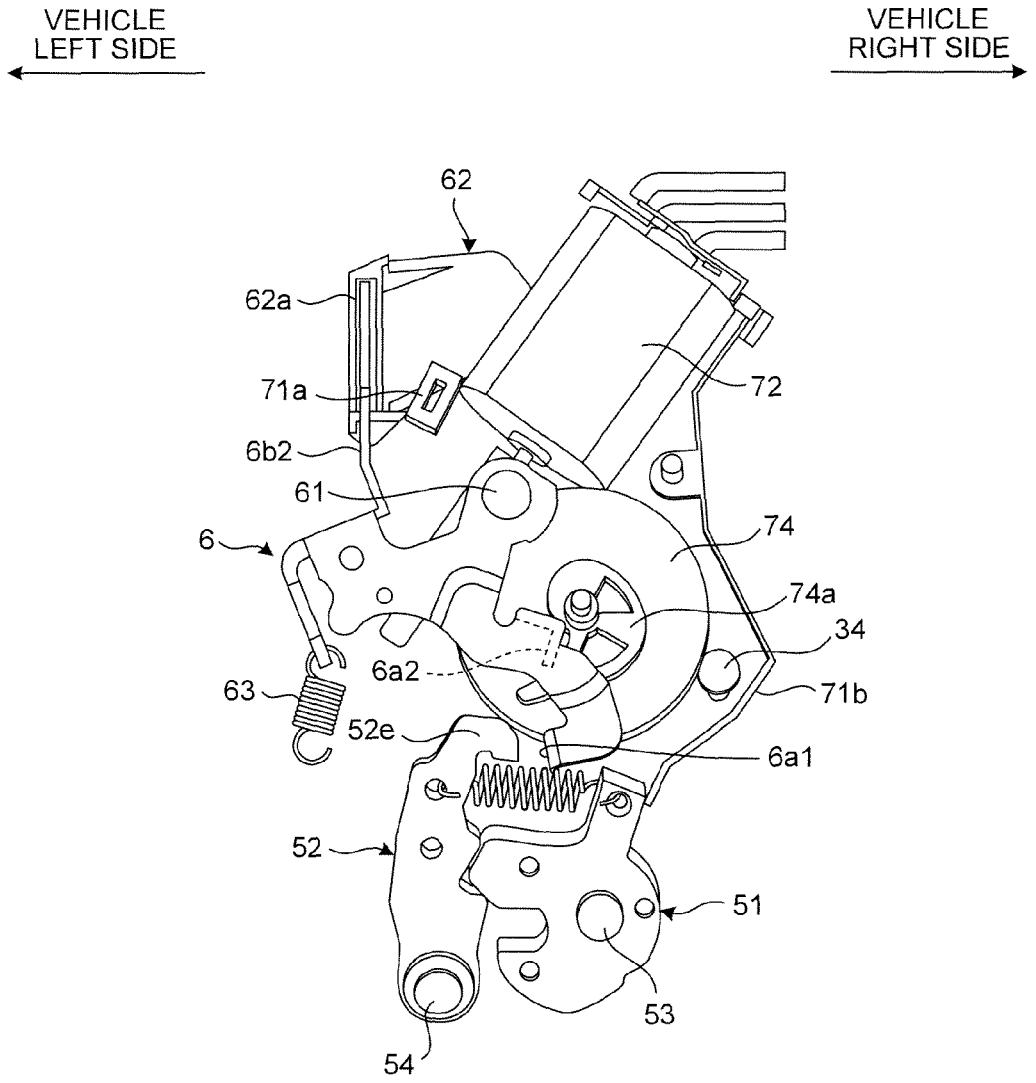
FIG. 12 is a rear view of FIG. 11.
Figure 13:
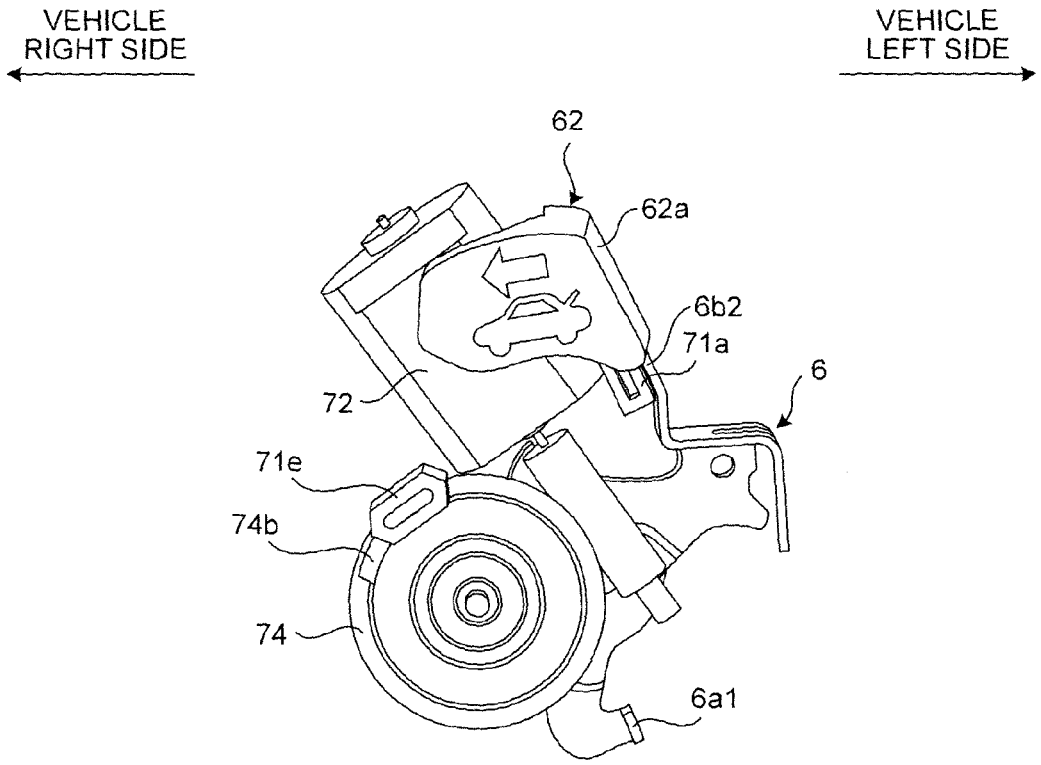
FIG. 13 is a view illustrating major parts of the internal configuration in a state that the open lever is operated by power.
Figure 14:
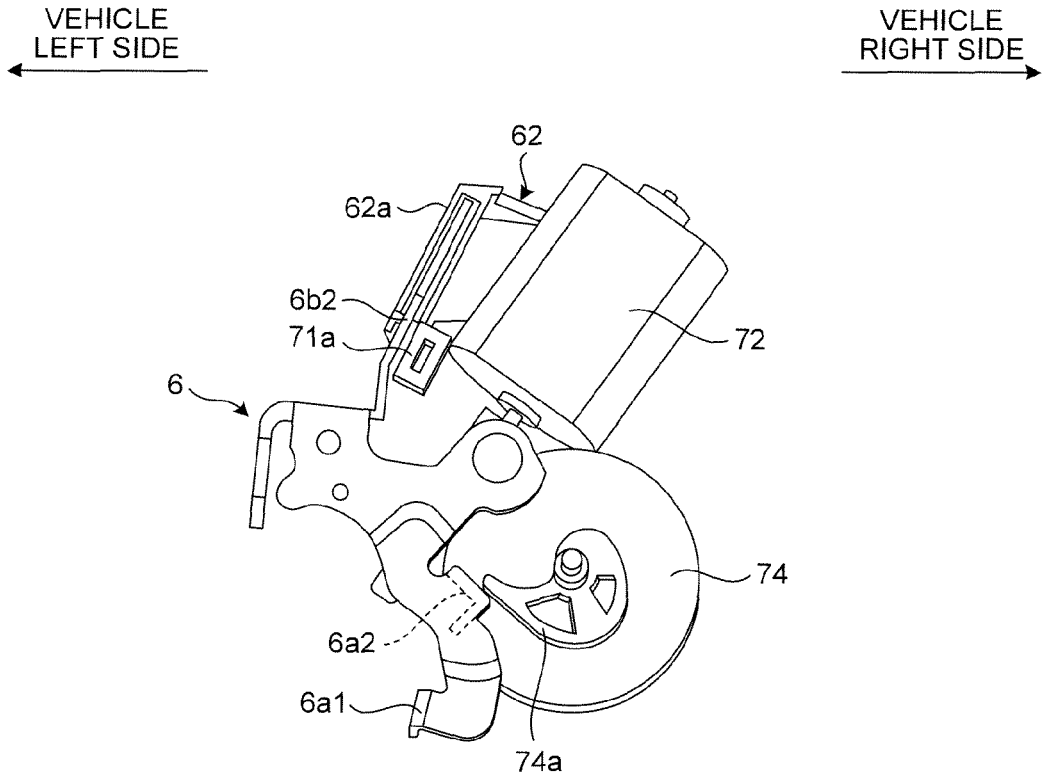
FIG. 14 is a rear view of FIG. 13.

FIG. 10 is a front view illustrating the internal configuration when the electric release type latch device illustrated in FIG. 1 is in the latched state. FIG. 11 is a view illustrating major parts of the internal configuration including a configuration of the actuator illustrated in FIG. 10. FIG. 12 is a rear view of FIG. 11. FIG. 13 is a view illustrating major parts of the internal configuration in a state that the open lever is operated by the power. FIG. 14 is a rear view of FIG. 13.

The electric release type latch device 1 is to release the abutment and the engagement between the latch 51 and the ratchet 52 by operating the open lever 6 by the power. In the base plate 3 of the electric release type latch device 1, the actuator 7 serving as the electric release unit for operating the open lever 6 by the power is installed as illustrated in FIG. 10. The actuator 7 presses the driven portion 6*a*2 of the open lever 6 by the power and rotates the open lever 6 counter-clockwise in FIG. 10. Thereby, the action end portion 6*a*1 of the open lever 6 presses the action end portion 52*e* of the ratchet 52, so that the ratchet 52 is disengaged from the latch 51. The actuator 7 includes a case 71, a motor 72, a worm 73, and a worm wheel 74 as illustrated in FIGS. 10 to 12.

The motor 72 serves as a drive source of the actuator 7, and the worm 73 is attached to an output shaft thereof. The motor 72 and the worm wheel 74 are attached to the case 71 in such a manner that the worm 73 and the worm wheel 74 are meshed with each other. The case 71 includes a connector 71*c*. Electric power for rotating the motor 72 is supplied from a power supply circuit (not illustrated) of a control unit via the connector 71*c*. The signal terminal 71*b* for detecting the position of the latch 51 is attached to the case 71. The signal terminal 71*b* abuts against a switch pin 34 installed upright in the upper region 3B of the base plate 3 in a case where the latch 51 is placed at the open position. The signal terminal 71*b* is also pressed by the signal terminal pressing portion 51*f* of the latch 51 and taken away from the switch pin 34 in a case where the latch 51 is placed at the latch position. The connector 71*c* outputs a conduction signal to the control unit only in a case where the signal terminal 71*b* abutted with the switch pin 34 provided in the base plate 3.

A projection 74*b* is provided on a front surface (surface on the side of the trunk room) of the worm wheel 74, and a worm wheel stopper 71*e* to be abutted with this is attached to an interior of the case 71. A return spring (not illustrated) is attached between the worm wheel 74 and the case 71. The return spring is attached so as to store elastic return force in a case where the motor 72 is rotated and the worm wheel 74 is rotated clockwise in FIG. 11. Therefore, when the motor 72 stops, the worm wheel 74 rotates counter-clockwise in FIG. 11 due to the elastic return force of the return spring. The worm wheel 74 rotated counter-clockwise in FIG. 11 stops when the projection 74*b* abuts against the worm wheel stopper 71*e*. Thereby, while the motor 72 is stopped, the worm wheel 74 is always stopped at the same stop position.

A cam 74*a* for pressing the driven portion 6*a*2 provided in the open lever 6 is provided on a rear surface (surface on the side of the base plate 3) of the worm wheel 74. The worm wheel 74 is attached to the base plate 3 in such a manner that the driven portion 6*a*2 of the open lever 6 is placed between the base plate 3 and the worm wheel 74 as illustrated in FIG. 12. Further, the cam 74*a* of the worm wheel 74 is arranged on a rotational trajectory of the driven portion 6*a*2 of the open lever 6 and at a position in the moving direction of the driven portion 6*a*2 by biasing force of the pulling coil spring 63. Therefore, in a case where the worm wheel 74 is stopped at the stop position, the driven portion 6*a*2 of the open lever 6 always abuts against the same position of the cam 74*a*. That is, the cam 74*a* serves as an electric release stopping unit for always stopping the open lever 6 at the same standby position in a case where the worm wheel 74 stops at the stop position.

A cam surface in the cam 74*a* is provided so as to extend in the clockwise direction in FIG. 12 from a root part whose distance from a rotation shaft (cam shaft) of the worm wheel 74 is the shortest in such a manner that the distance from the cam shaft becomes longer as it is taken away from the root part. The cam surface of the cam 74*a* is provided in such a manner that the driven portion 6*a*2 of the open lever 6 abuts against the root part of the cam surface in a case where the worm wheel 74 is stopped at the stop position. Therefore, when the worm wheel 74 rotates counter-clockwise in FIG. 12, the cam 74*a* presses the driven portion 6*a*2 provided in the open lever 6. Thereby, the open lever 6 rotates in the direction in which the action end portion 6*a*1 presses the action end portion 52*e* of the ratchet 52 (clockwise direction in FIG. 12). As a result, the abutment and the engagement between the latch 51 and the ratchet 52 are released as illustrated in FIGS. 13 and 14.

In the latched state in which the latch 51 and the ratchet 52 abut against and engage with each other, the signal terminal pressing portion 51*f* of the latch 51 presses the signal terminal 71*b*. At this time, the signal terminal 71*b* is away from the switch pin 34 as illustrated in FIG. 10. From the latched state, when the motor 72 is rotated, the open lever 6 is operated, and the latch 51 is rotated to the open position, the signal terminal 71 abuts against the switch pin 34 as illustrated in FIG. 4. When the signal terminal 71*b* abuts against the switch pin 34, the conduction signal is outputted from the connector 71*c* to the control unit. The control unit detects that the latch 51 reaches the open position by the conduction signal and stops the motor 72. When the motor 72 stops, the worm wheel 74 rotates in the direction of the stop position (counter-clockwise direction in FIG. 14) by biasing force of the return spring. When the worm wheel 74 returns to the stop position, the projection 74*b* abuts against the worm wheel stopper 71*e*, so that the worm wheel 74 stops. When the worm wheel 74 returns to the stop position, the cam 74*a* of the worm wheel 74 also returns to the position illustrated in FIG. 12. Therefore, the open lever 6 returns to the standby position and stops as illustrated in FIGS. 11 and 12 by the biasing force of the pulling coil spring 63.

A cushion material 71*a* and ribs 71*d* are provided on the outside of the case 71. The cushion material 71*a* is a member to abut against the operation end portion 6*b*2 and the operation handle 62 in a case where the open operation of the open lever 6 is performed. The cushion material 71*a* is formed of an elastic material such as a rubber and suppresses generation of abnormal noise or the like due to collision of the open lever 6 operated by the power with the case 71.

The ribs 71*d* are provided at positions facing the operation handle 62 in the case 71. The operation handle 62 of the open lever 6 is a member for enabling the person locked in the trunk room to operate the open lever 6. The operation handle 62 is placed on the outside of the base plate 3 and the protector cover 4 as illustrated in FIG. 1. The electric release type latch device 1 provided with the operation handle 62 is attached to the trunk lid in such a manner that the operation handle 62 can be visually recognized from the trunk room and can be operated from the trunk room in a state that the trunk lid is closed. Therefore, there is sometimes a case where an unintentional pressing load may be applied onto the operation handle 62 from the side of the trunk room, for example, articles accommodated in the trunk room may touch the operation handle 62. The ribs 71*d* of the case 71 are provided for preventing the operation handle 62 from deforming due to such an unintentional pressing load.

Figure 15:
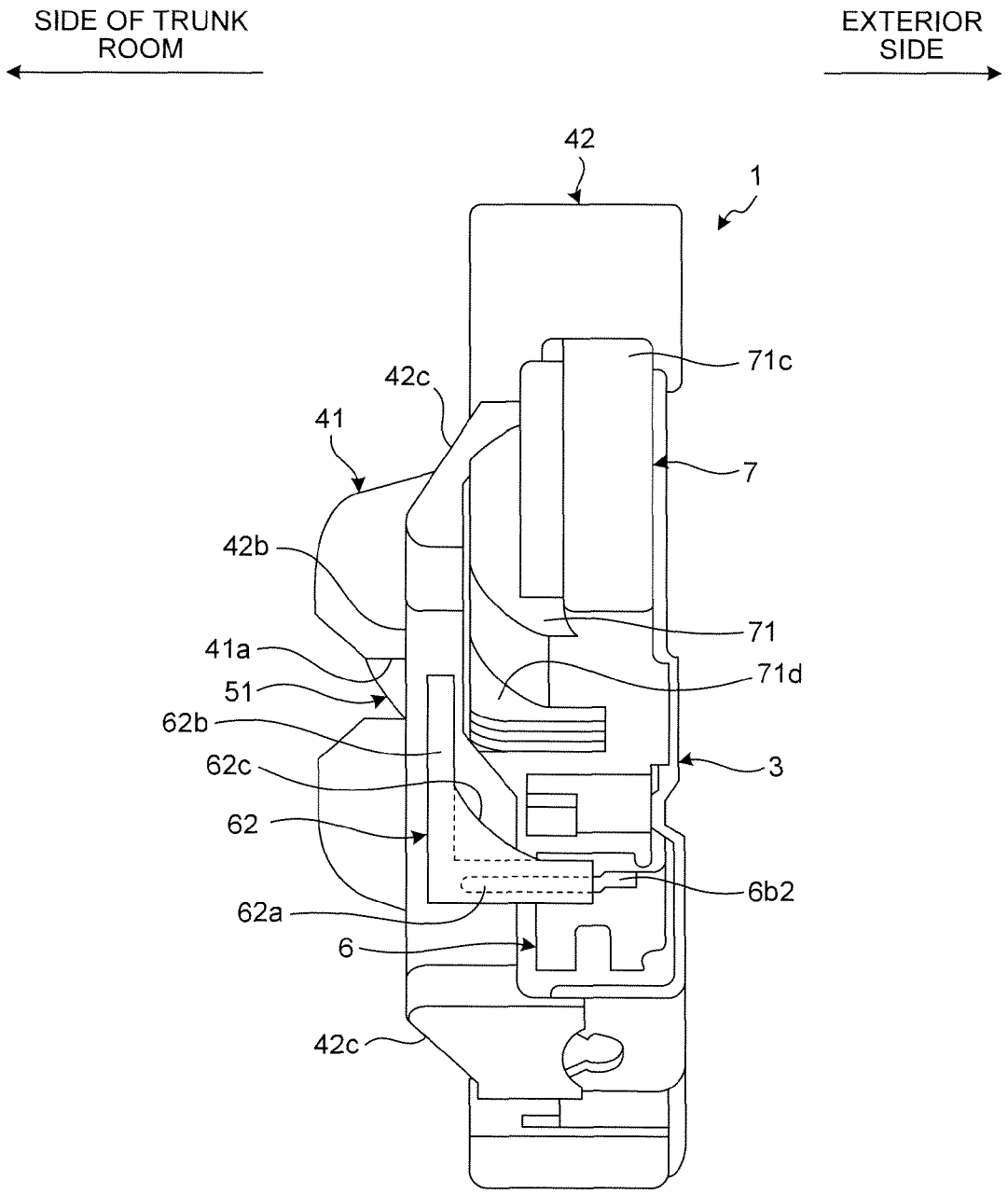
FIG. 15 is a view in which the electric release type latch device illustrated in FIG. 2 is seen from the obliquely upper side, the view in which an upper region of a base plate is seen from an upward extended position.

FIG. 15 is a view in which the electric release type latch device illustrated in FIG. 2 is seen from the obliquely upper side, the view in which the upper region of the base plate is seen from an upward extended position.

The operation handle 62 includes a fitting portion 62*a*, a display portion 62*b*, and a rib 62*c* as illustrated in FIG. 15. The fitting portion 62*a* is a part that fits with the operation end portion 6*b*2. The display portion 62*b* is a part extending from an end part of the fitting portion 62*a* on the side of the trunk room in the direction in which the operation end portion 6*b*2 is moved when the open lever 6 is operated. Graphics notifying the trunk lid can be opened, and the moving direction of the operation handle 62 are printed on a surface of the display portion 62*b* facing the side of the trunk room. The rib 62*c* is provided in a corner part in which the fitting portion 62*a* and the display portion 62*b* are connected in order to prevent the display portion 62*b* from deforming.

The display portion 62*b* of the operation handle 62 is overlapped with the case 71 in a state that the open lever 6 is at the standby position, and provided in such a manner that a part overlapped with the case 71 is placed on the side of the trunk room with respect to the case 71. The ribs 71*d* of the case 71 are provided at the positions facing the display portion 62*b* of the operation handle 62 in the case 71. Therefore, in a case where an unintentional pressing load is applied onto the display portion 62*b* of the operation handle 62 from the side of the trunk room, the operation handle 62 is abutted with and supported by the ribs 71*d* of the case 71. Thereby, the deformation of the display portion 62*b* due to an unintentional pressing load can be suppressed. In a case of the power operation or the manual operation via the operation handle 62, the open lever 6 rotates in such a manner that the operation handle 62 is being along a surface facing the trunk room. Therefore, a situation that an unintentional pressing load is applied onto the operation handle 62 and the open lever 6 is rotated to the operation position can be prevented from occurring. Accordingly, a situation that the abutment and the engagement between the latch 51 and the ratchet 52 are released due to an unintentional pressing load can be prevented from occurring.

The electric release type latch device 1 is provided with the protector cover 4 as illustrated in FIGS. 1 and 2. The protector cover 4 is a cover member for protecting the latch 51, the ratchet 52, the open lever 6, and the like arranged in the base plate 3. The protector cover 4 includes a first cover 41 and the second cover 42. The first cover 41 is a member that covers the lower region 3A of the base plate 3, and includes a striker incoming groove 41*a*. The second cover 42 is a member that covers the upper region 3B of the base plate 3 in a state that the operation handle 62 and the connector 71*c* of the case 71 are exposed to an exterior. The second cover 42 includes a reference surface 42*a*, a protector surface 42*b*, and an inclined surface 42*c* on a surface facing the side of the trunk room in a state that the trunk lid is closed.

The reference surface 42*a* of the second cover 42 is a flat surface that specifies a reference position serving as a border from the trunk room. The reference position is specified based on attachment height of the open lever 6 or the like in the upper region 3B of the base plate 3 and size of the trunk lid to which the electric release type latch device 1 is attached. The protector surface 42*b* is a flat surface extending along a periphery of a moving range of the operation handle 62. The protector surface 42*b* is provided so as to be placed closer to the side of the trunk room than the reference surface 42*a* and the display portion 62*b* of the operation handle 62 are. The inclined surface 42*c* is a surface connecting the reference surface 42*a* and the protector surface 42*b* and is displaced toward the side of the trunk room as the inclined surface 42*c* approaches the protector surface 42*b*.

In such a way, when the protector surface 42*b* is provided in the periphery of the operation handle 62, and in a case where articles in the trunk room move toward the electric release type latch device 1, the articles touch the protector surface 42*b*. Therefore, contact between the articles and the operation handle 62 can be avoided.

In the electric release type latch device 1 described above, when the open operation by the actuator 7 is finished and the motor 72 is stopped, the worm wheel 74 returns to the stop position and stops. At this time, since the projection 74*b* abuts against the worm wheel stopper 71*e* provided in the case 71, the worm wheel 74 always stops at the same position. Therefore, in a case where the worm wheel 74 is stopped at the stop position, the driven portion 6*a*2 of the open lever 6 to be abutted with the cam 74*a* of the worm wheel 74 always stops in a state that the driven portion is abutted with the same position of the cam 74*a*. That is, the open lever 6 at the time of non-operation always stops at the same standby position. Accordingly, in the electric release type latch device 1 described above, there is no need for providing a stopper portion for stopping the open lever 6 at the standby position independently aside from the driven portion 6*a*2 of the open lever 6 and the cam 74*a* of the worm wheel 74. The driven portion 6*a*2 of the open lever 6 is placed between the operation portion 6*b* of the open lever 6 and the action end portion 6*a*1 and overlapped with the base plate 3 between the base plate 3 and the rear surface of the worm wheel 74. Therefore, the open lever 6 and the actuator 7 can be rationally arranged in the base plate 3, so that the device can be downsized.

In the electric release type latch device 1 described above, the driven portion 6*a*2 provided in the open lever 6 is placed between the base plate 3 and the case 71. Thus, the device can be downsized. The cam 74*a* provided in the worm wheel 74 presses the driven portion 6*a*2 provided in the open lever 6. From this point, the device can also be downsized. Since rotation of the worm wheel 74 is directly transmitted to the open lever 6, power transmission is efficient.

Further, in the electric release type latch device 1 described above, the display portion 62*b* of the operation handle 62 is overlapped with the case 71 and placed on the side of the trunk room with respect to the case 71. Therefore, when articles in the trunk room touch the operation handle 62 and even an unintentional pressing load is applied onto the display portion 62*b*, the operation handle 62 is abutted with and supported by the ribs 71*d* of the case 71. Accordingly, the deformation of the display portion 62*b* due to an unintentional pressing load can be suppressed. Moreover, the protector surface 42*b* placed on the side of the trunk room with respect to the display portion 62*b* of the operation handle 62 is provided in the second cover 42 of the protector cover 4. Therefore, in a case where articles in the trunk room are moved toward the electric release type latch device 1, the articles touch the protector surface 42*b*. Thereby, an abutment itself of the articles in the trunk room with the operation handle 62 can be suppressed.

Figure 16:
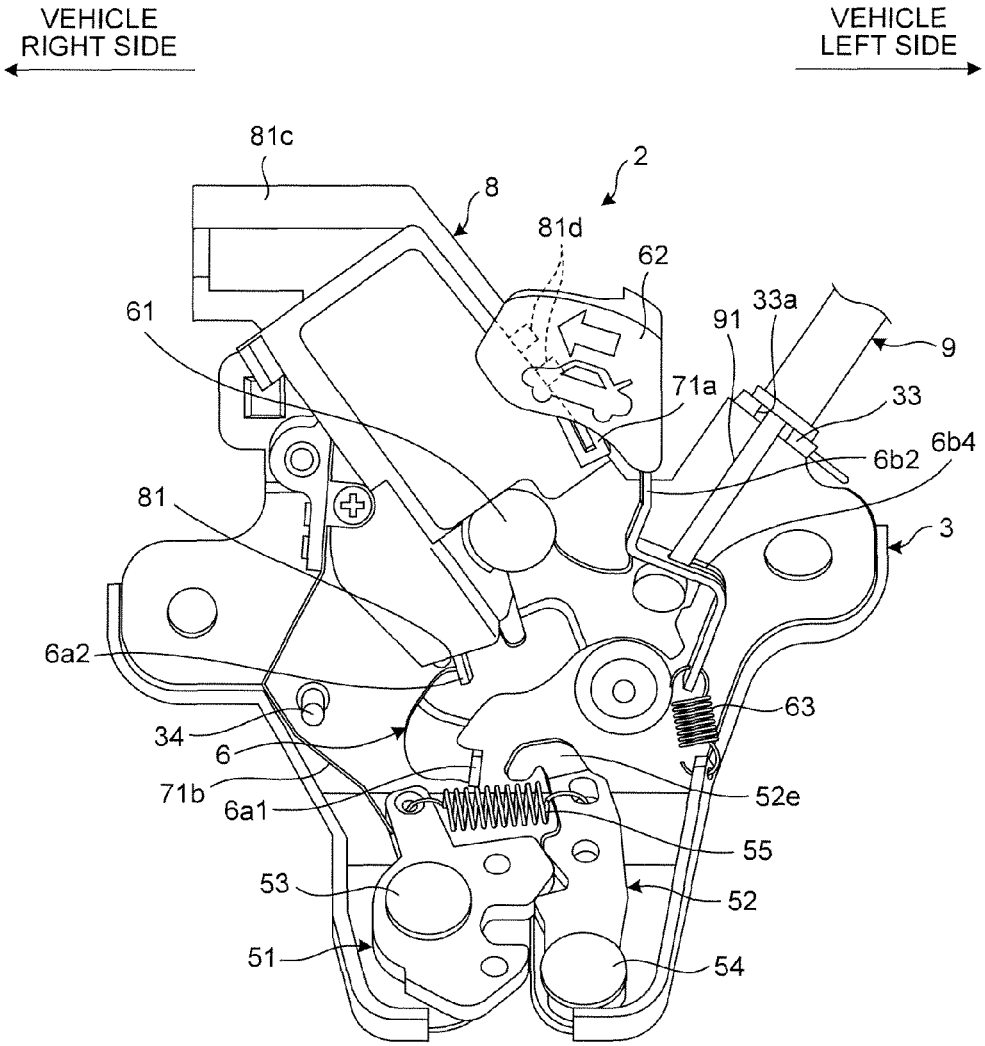
FIG. 16 is a front view illustrating the internal configuration when the manual release type latch device illustrated in FIG. 1 is in a latched state.
Figure 17:
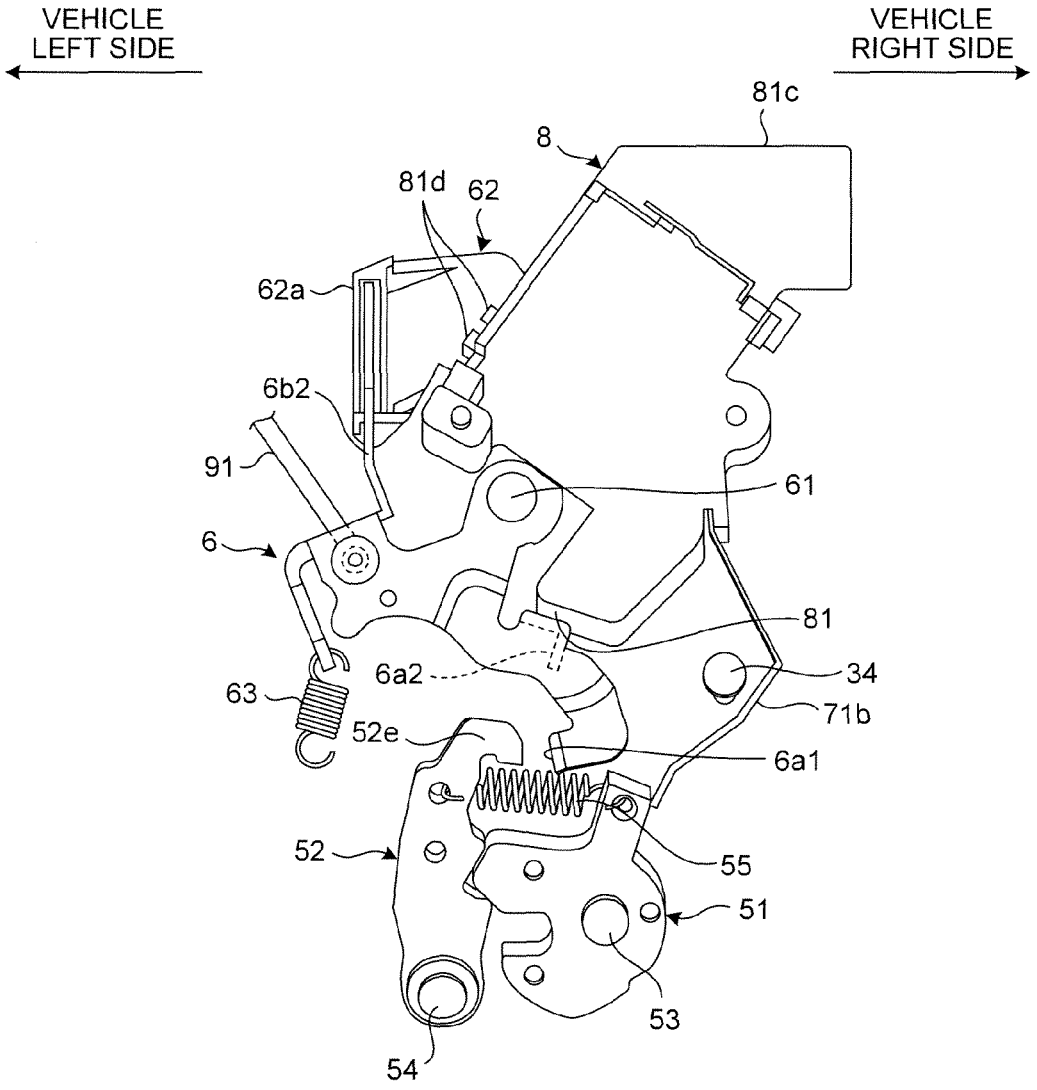
FIG. 17 is a rear view illustrating major parts of the internal configuration illustrated in FIG. 16.
Figure 18:
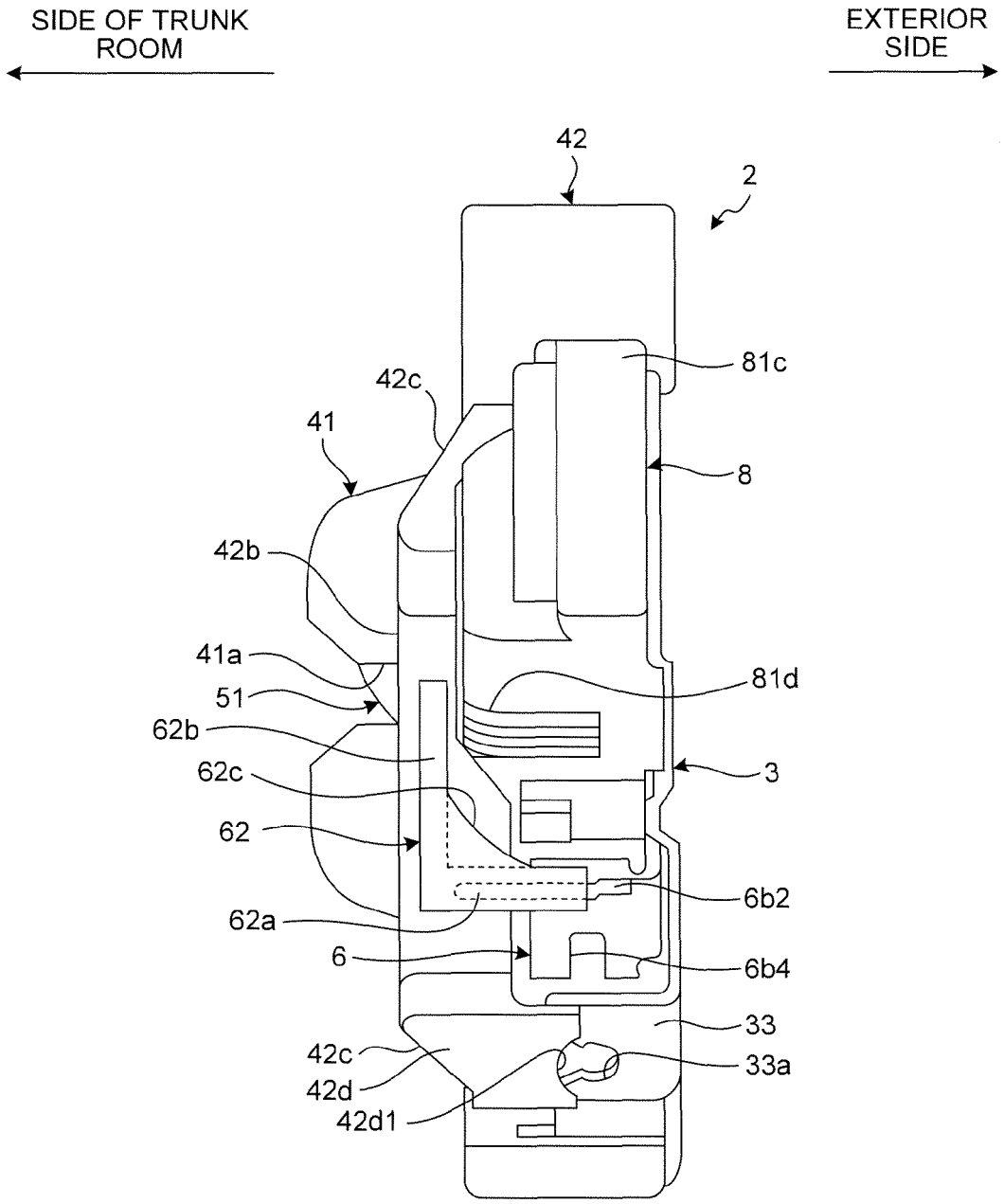
FIG. 18 is a view in which the manual release type latch device illustrated in FIG. 2 is seen from the obliquely upper side, the view in which the upper region of the base plate is seen from the upward extended position.

FIG. 16 is a front view illustrating the internal configuration when the manual release type latch device illustrated in FIG. 1 is in the latched state. FIG. 17 is a rear view illustrating major parts of the internal configuration illustrated in FIG. 16. FIG. 18 is a view in which the manual release type latch device illustrated in FIG. 2 is seen from the obliquely upper side, the view in which the upper region of the base plate is seen from the upward extended position.

The manual release type latch device 2 is to manually operate the open lever 6 so as to release the abutment and the engagement between the latch 51 and the ratchet 52. In the manual release type latch device 2, as illustrated in FIGS. 16 and 17, a wire 91 of an operation cable 9 is installed in the wire installment groove 6*b*4 of the open lever 6. The operation cable 9 is engaged with the cable attachment portion 33 provided in the base plate 3 and the cable attachment portion 42*d* provided in the second cover 42 of the protector cover 4. As illustrated in FIG. 18, the recessed portion 33*a* with which the operation cable 9 is engaged and into which the wire 91 is inserted is provided in the cable attachment portion 33 of the base plate 3. As illustrated in FIG. 18, the recessed portion 42*d*1 to be engaged with the operation cable 9 is provided in the cable attachment portion 42*d* of the second cover 42. As illustrated in FIG. 16, a locking member (not illustrated) is attached to one end of the wire 91, and the locking member is hanged onto the base portion 6*b*1 of the open lever 6 so as to connect the wire 91 and the open lever 6. The other end of the wire 91 is connected to for example the trunk lever provided in the vicinity of the driver seat. When the trunk lever is operated, the wire 91 is pulled, so that the open lever 6 rotates counter-clockwise in FIG. 16.

In the base plate 3 of the manual release type latch device 2, in place of the actuator 7 described above, the case 8 serving as the manual release unit is installed as illustrated in FIGS. 16 and 17.

The signal terminal 71*b* that detects the position of the latch 51 is attached to the case 8. The signal terminal 71*b* is abutted with the switch pin 34 standing on the base plate 3 in a case where the latch 51 is moved to the open position, so as to obtain the conduction signal. The case 8 includes a connector 81*c*. The connector 81*c* outputs the conduction signal to the control unit only in a case where the signal terminal 71*b* is abutted with the switch pin 34 provided in the base plate 3.

The stopper portion 81 is formed in the case 8. The stopper portion 81 is to always stop the open lever 6 at the same standby position. Similarly with the cam 74*a* of the worm wheel 74 in the electric release type latch device 1, the stopper portion 81 is arranged on the rotational trajectory of the driven portion 6*a*2 of the open lever 6 and at the position in the moving direction of the driven portion 6*a*2 by the biasing force of the pulling coil spring 63.

The cushion material 71*a* and ribs 81*d* are provided on the outside of the case 8. The cushion material 71*a* is provided in order to suppress generation of abnormal noise or the like due to a collision of the open lever 6 with the case 8 in a case where the open operation of the open lever 6 is performed. The ribs 81*d* are the same as the ribs 71*d* of the case 71 in the electric release type latch device 1, and are provided at positions facing the operation portion 6*b* of the operation handle 62 in the case 8 as illustrated in FIGS. 16 to 18.

In the manual release type latch device 2 described above, by operating the trunk lever provided in the vicinity of the driver seat, the open lever 6 is manually operated via the wire 91 of the operation cable 9, so that the abutment and the engagement between the latch 51 and the ratchet 52 are released. At this time, the open lever 6 which is manually operated is rotated clockwise in FIG. 17 and the action end portion 52*e* of the ratchet 52 is pressed by the action end portion 6*a*1. After that, when the trunk lever is returned to a state before the operation, the open lever 6 rotates in the direction opposite to the case of the manual operation by the biasing force of the pulling coil spring 63 and returns to the standby position illustrated in FIG. 17. At this time, the driven portion 6*a*2 of the open lever 6 abuts against the stopper portion 81 of the case 8. Thus, the open lever 6 always stops at the same standby position. Therefore, for the manual release type latch device 2 described above, there is no need for providing a stopper portion for stopping the open lever 6 at the standby position other than the driven portion 6*a*2 of the open lever 6 and the stopper portion 81 of the case 8.

Accordingly, there is also no need for providing a stopper portion for stopping the open lever 6 at the standby position by cutting and bending the base plate 3. Thereby, in a case where the open lever 6 is standardized between the electric release type latch device 1 and the manual release type latch device 2, there is also no need for cutting and bending the base plate 3 while avoiding an arrangement space of the worm wheel 74. Therefore, as described above, the base plate 3 is easily standardized. The stopper portion 81 can be attached at a position where the cam 74*a* of the worm wheel 74 corresponding to the electric release stopping unit in the electric release type latch device 1. Thus, the device can be downsized.

Further, in the manual release type latch device 2 described above, the display portion 62*b* of the operation handle 62 is overlapped with the case 8 and placed on the side of the trunk room with respect to the case 8. Therefore, when articles in the trunk room touch the operation handle 62 and an unintentional pressing load is applied onto the display portion 62*b*, the operation handle 62 is abutted with and supported by the ribs 81*d* of the case 8. Accordingly, the deformation of the display portion 62*b* due to an unintentional pressing load can be suppressed. Moreover, the protector surface 42*b* placed on the side of the trunk room with respect to the display portion 62*b* of the operation handle 62 is provided in the second cover 42 of the protector cover 4. Therefore, in a case where articles in the trunk room move toward the manual release type latch device 2, the articles touch the protector surface 42*b*. Thereby, the abutment itself of the articles in the trunk room with the operation handle 62 can be suppressed.

As described above, the latch device described in the present embodiment has a structure that a manual release stopping unit (stopper portion 81 of the case 8) and the electric release stopping unit (cam 74*a* of the worm wheel 74) are selectively attached to the base plate 3 as a stopping unit to be abutted with the driven portion 6*a*2 provided in the open lever 6, so as to stop the open lever 6 at the standby position. Therefore, there is no need to provide a stopping unit for stopping the open lever 6 at the standby position in the base plate 3. Thereby, the base plate 3 and the open lever 6 can be standardized between the electric release type latch device 1 and the manual release type latch device 2, so that the number of part items to be managed can be reduced and the number of a stock of parts can be reduced. In any of the electric release type latch device 1 and the manual release type latch device 2, the manual release stopping unit and the electric release stopping unit for retaining the open lever 6 at the standby position can be provided in a rotational trajectory of the worm wheel 74. Thus, the device can be downsized.

Further, in the electric release type latch device 1 and the manual release type latch device 2 described above, in a case where a pressing load is applied onto the operation handle 62 from the side of the trunk room, the case 71 or the case 8 overlapped with the display portion 62*b* of the operation handle 62 is abutted with the operation handle 62 so as to support the operation handle. Therefore, the deformation of the display portion 62*b* due to an unintentional pressing load can be suppressed. Moreover, the protector surface 42*b* placed on the side of the trunk room with respect to the display portion 62*b* of the operation handle 62 is provided in the second cover 42 of the protector cover 4. Therefore, in a case where articles in the trunk room move toward the electric release type latch device 1 or the manual release type latch device 2, the articles touch the protector surface 42*b*. Thereby, the abutment itself of the articles in the trunk room with the operation handle 62 can be suppressed.

It should be noted that in the above embodiment, the latch device for retaining the trunk lid in a closed state is described. However, configurations of the open lever 6, the actuator 7, and the case 8 of the present invention are not limited to this but the present invention can be applied to a latch device for retaining a back door provided in a rear end part of the vehicle main body or doors provided on the left and right sides of the vehicle main body in a closed state.

The display portion 62*b* of the operation handle 62 may be supported by a support member which is different from the case 71 forming the electric release unit and the case 8 forming the manual release unit. The support member supporting the display portion 62*b* is only required to be overlapped with the display portion 62*b* at least in a case where the open lever 6 is at the standby position. Therefore, the display portion 62*b* of the operation handle 62 may extend in the direction opposite to the operation direction of the open lever 6 and the support member may be provided at a position to be overlapped with the display portion 62*b*.

Further, in a case where the electric release type latch device 1 and the manual release type latch device 2 described above are attached to the trunk lid, in place of the second cover 42, a surface corresponding to the protector surface 42*b* and the inclined surface 42*c* may be provided in the trunk lid.

With the latch device according to the present invention, the electric release unit to be installed in the electric release type latch device in which the open lever is operated by the power and the manual release unit to be installed in the manual release type latch device in which the open lever is manually operated can be selectively installed in the base plate. The manual release unit is provided with the manual release stopping unit to be abutted with the driven portion provided in the open lever in a case where the unit is installed in the base plate, so as to stop the open lever at the standby position. Therefore, there is no need for providing a stopping unit for stopping the open lever at the standby position in the base plate. Therefore, in the manual release type latch device and the electric release type latch device, the base plate and the open lever can be standardized and the device can be downsized.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A latch device, comprising:

a base plate;

an open lever rotatably attached to the base plate;

a biasing unit; and an electric release unit to be installed in an electric release type latch device in which the open lever is operated by power and a manual release unit to be installed in a manual release type latch device in which the open lever is manually operated are configured to be selectively installed in the base plate, wherein the open lever includes an action end portion configured to press a ratchet engaged with a latch and disengaging the ratchet from the latch, the biasing unit biases the open lever in a direction in which the action end portion and the ratchet are away from each other, and the manual release unit is provided with a manual release stopping unit to abut against a driven portion provided in the open lever in a case where the unit is installed in the base plate, so as to stop the open lever at a standby position, the latch device is configured to be attached to any one of a trunk main body or a trunk lid forming a trunk room in a vehicle, an operation handle facing an interior of the trunk room in a state that the trunk lid is closed is provided in the open lever, a support member to abut against the operation handle at least in a state that the open lever is placed at the standby position and in a case where a pressing load is applied to the operation handle from the side of the trunk room, so as to support the operation handle is provided, the operation handle is provided so as to move along a surface facing the trunk room in a case where the open lever is operated by the power or manually, the operation handle is placed on a side of the trunk room with respect to the support member, and the support member is provided so as to overlap with the operation handle in a direction orthogonal to the moving direction of the operation handle.

2. The latch device according to claim 1, wherein the driven portion is provided between the action end portion and an operation portion and pressed by the electric release unit in a case where the electric release unit is installed, so as to operate the open lever by the power.

3. The latch device according to claim 1, wherein the manual release stopping unit is provided in a case that constitutes the manual release unit.

4. The latch device according to claim 3, wherein the case includes a connector configured to output a conduction signal.

5. The latch device according to claim 1, wherein the electric release unit includes a worm wheel configured to press the driven portion so as to operate the open lever by the power, and the worm wheel serves as an electric release stopping unit that stops the open lever at the standby position in a case where the worm wheel stops at a stop position.

6. The latch device according to claim 1, wherein the operation handle includes a fitting portion to be fitted to the operation portion of the open lever, and a display portion extending in a operation direction of the open lever from the fitting portion, and the display portion and the support member overlap with each other.

7. The latch device according to claim 1, wherein the support member is a case that constitutes the electric release unit or a case that constitutes the manual release unit.

8. The latch device according to claim 7, wherein the case includes a rib on a surface facing the operation handle.

9. The latch device according to claim 1, further comprising:

a protector cover configured to cover the open lever in a state that the operation handle is exposed to an exterior, wherein the protector cover includes:

a reference surface configured to regulate a reference position serving as a border from the trunk room;

a protector surface extending along a periphery of the operation handle and protruding toward the inside of the trunk room with respect to the reference surface; and an inclined surface connecting the reference surface and the protector surface.

* * * * *